US005128647A

United States Patent [19]

Truchet

[11] Patent Number: 5,128,647

[45] Date of Patent: Jul. 7, 1992

[54] HAND CONTROLLED BREAKER

[75] Inventor: Bernard Truchet, Besayes, France

[73] Assignee: SEXTANT Avionique, Meudon la Foret Cedex, France

[21] Appl. No.: 702,818

[22] Filed: May 21, 1991

[30] Foreign Application Priority Data

May 22, 1990 [FR] France ..... 90 06605

[51] Int. Cl.[5] ..... H01H 71/16

[52] U.S. Cl. ..... 337/66; 337/70; 200/539

[58] Field of Search ..... 337/66, 62, 70, 71, 337/72, 73, 74, 75; 335/21, 24, 43; 200/537, 538, 539

[56] References Cited

U.S. PATENT DOCUMENTS 3,361,882 1/1968 Clarke .
3,486,150 9/1967 Clarke .

FOREIGN PATENT DOCUMENTS 1092997 7/1959 Fed. Rep. of Germany .

*Primary Examiner*—Harold Broome
*Attorney, Agent, or Firm*—Lowe, Price, LeBlanc & Becker

[57] ABSTRACT

A hand-controlled breaker comprises a housing (1), a control button (12), and a control bar (21). Two rods (15, 15') are mounted so as to pivot inside the control button, and extend downwardly outside the control button towards the cavity of said housing. Each rod comprises an oblique supporting surface (17, 17') oriented in an inward and downward position, and a second lower oblique supporting surface (19, 19') oriented in an inward and upward position. The four supporting surfaces surround and maintain a cylindrical part (20) coupled to an upper portion of the bar (21). The rods each further comprise an oblique supporting surface (58, 58') outwardly and upwardly directed to against a lower edge of a bore (10) of an upper portion (4) of the housing.

2 Claims, 5 Drawing Sheets

FIG. 5
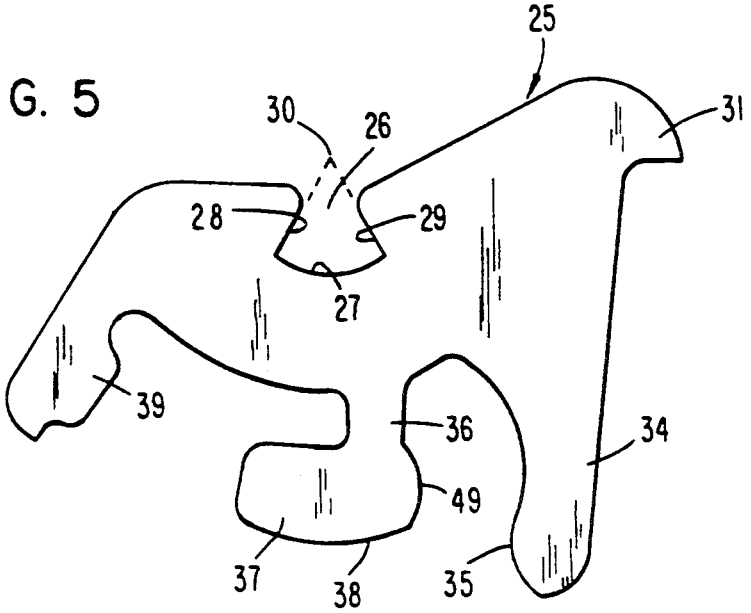
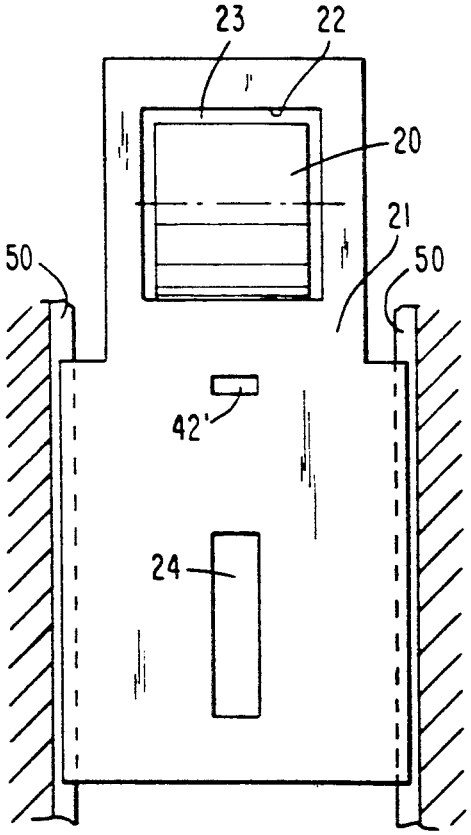
FIG. 6
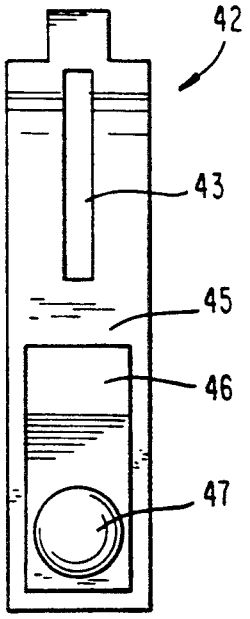
FIG. 7

HAND CONTROLLED BREAKER

FIELD OF THE INVENTION

The present invention relates to circuit breakers comprising a hand operated device to put them in the OFF or ON position and liable to be automatically tripped when the current flowing therethrough is too high.

BACKGROUND OF THE PRIOR ART

Such manually controlled breakers are generally designed so as to provide a satisfactory reliability at a minimum cost, especially desirable when these breakers are manufactured in mass production and are intended for relatively common use.

To avoid damaging the electric contacts of the breaker, the latter must include a device permitting a rapid displacement of the electric contacts, under all conditions, during an ON or OFF operation of the contacts. Indeed, if a breaker is provided with a contact activating device allowing them to move rapidly, a user slowly activating the operating button of the breaker may cause an electric arc during a period of time long enough for damaging contacts.

On the other hand, the breakers known in the prior art comprise a large number of components, mounted so as to tilt or to pivot, interconnected or connected to the breaker housing by articulation means formed by articulation axles. The breakers of this type are relatively complex and consequently have a relatively high cost price and are difficult to miniaturize.

An object of the invention is to provide a manually controlled breaker, having a simple design and easy to miniaturize.

Another object of the invention is to provide a manually controlled breaker, comprising a device for rapidly engaging or releasing it independently of the way in which the breaker is activated by the user.

A further object of the invention is to provide a manually controlled breaker liable to be automatically tripped even if the user is activating it in the closing direction.

SUMMARY OF THE INVENTION

To achieve these objects, the breaker according to the invention comprises a housing and a control button capable of linear movement in the upper part of the housing; a control bar longitudinally arranged inside the housing and liable to be moved under the influence of the control button; a hinged part mounted on the control bar so as to pivot and define the ON or OFF state of the breaker. The control button comprises two rods mounted so as to pivot inside the control button, in its upper part, and extending downwardly at the outside of the control button towards the housing cavity, each of these rods comprising a first oblique supporting surface, oriented in the inward and downward direction and a second oblique supporting surface placed at a lower position, oriented in the inward and upward direction, these four supporting surfaces surrounding and maintaining in place a cylindric part connected to the upper part of the bar. The rods also comprise an oblique supporting surface oriented in the outward and upward direction, sliding against a lower edge of a bore of the upper part of the housing, so that, when the control button is moved upwardly, the rods slide along their external supporting surface against a lower edge of the bore, thus bringing the rods closer and allowing them to pass through the bore when the control button is placed to the upper position.

According to a preferred embodiment of the invention, the angle formed by the first oblique supporting surface oriented inwardly and downwardly with respect to the longitudinal axis is higher than the angle formed by the oblique supporting surface oriented outwardly and upwardly, so that when the control button is moved at the first upper position of its movement, the rods slide inside the bore of the upper portion of the housing, thus causing the displacement of the control bar having the same amplitude as the displacement of the control button and, when the control button is moved along the second lower part of its displacement, the bars slip out of the bore and their supporting surfaces start sliding to contact the lower edge, so that the displacement of the control button causes a smaller displacement of the control bar.

BRIEF DESCRIPTION OF THE DRAWINGS

The foregoing and other objects, features and advantages of the invention will be apparent from the following detailed description of a preferred embodiment as illustrated in the accompanying figures wherein:

FIG. 5 is a front view of a "hinged part" which is one of the components of the breaker according to the invention;

FIG. 6 is a side view of a "control bar" which is another component of the breaker according to the invention; and FIG. 7 is a side view of a "contact supporting part" which is a further component of the breaker according to the invention.

DETAILED DESCRIPTION OF THE INVENTION

Figure 1:
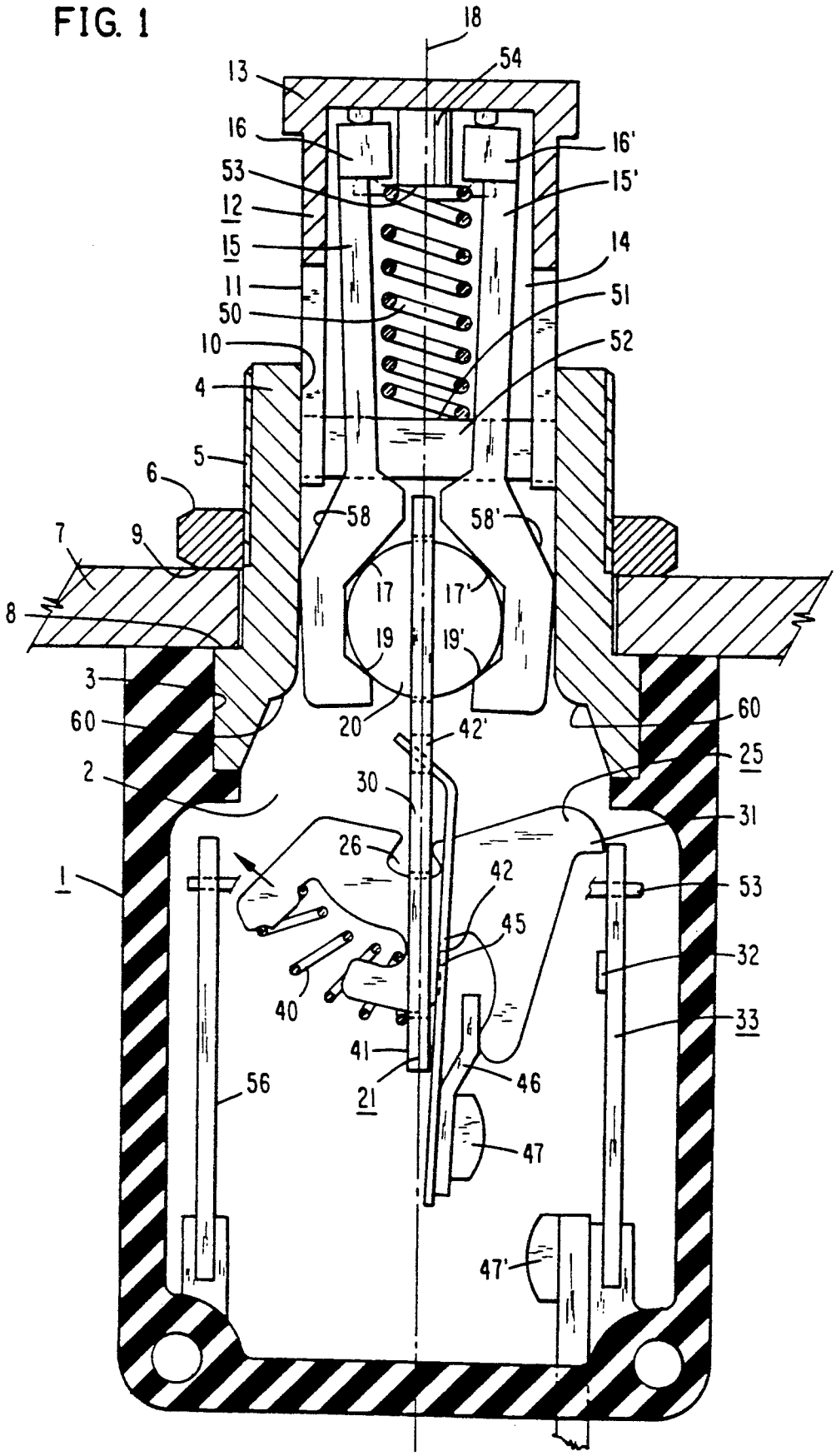
FIG. 1 is a longitudinal section view of a breaker according to the invention, in its tripping position, without control from the user.

FIG. 1 shows a housing 1, made of an insulating material, enclosing the mechanism constituting the breaker according to the invention. Housing 1 has a cavity 2 ending upwardly at the outside through an aperture shaped as a bore 3. A sleeve or spindle 4 is mounted in housing 1 by engagement in bore 3, and is rigidly fixed to the housing by any appropriate means, for example by bonding. Sleeve 4 projects outside of housing 1 and has an external cylindrical split surface 5 on which is screwed a nut 6 in order to detachably fix the breaker on a wall 7 of any apparatus, the wall 7 being pressed against a flange 8 of the sleeve 4 and against the downwardly oriented plane surface 9 of nut 6. The sleeve 4 has a cylindrical internal bore 10 in which longitudinally slides the external cylindrical surface 11 of a control button 12 which has an upper protruding portion 13 the shape of which is adapted to be handled by a user, in order to manually activate the breaker, either by pushing button 12 downwardly or by pulling it upwardly. The downward displacement of button 12 causes the engagement of the breaker, that is, the ON sate of the electric contacts, and its upward displacement causes it to trip, that is, to go to the OFF state of the contacts.

Button 12 comprises an internal recess 14 opening downwardly, wherein are introduced two identical rods 15, 15', the respective upper extremities 16 and 16' of which are pivotally connected to button 12 at the upper extremity of recess 14, to allow the rods 15, 15' to pivotally move at their upper extremities 16, 16', respectively, according to pivot axes perpendicular to the plane of FIG. 1. Each rod 15, 15' longitudinally extends downwardly and inside cavity 2 of housing 1 and has a first plane surface 17, 17' oblique with respect to the longitudinal axis 18 of the breaker and oriented in the inward and downward position, as well as a second plane surface 19, 19', arranged at a lower level than the first plane surface and oblique with respect to the longitudinal axis 18 in order to be oriented inwardly and upwardly. The two rods 15, 15' are symmetrically arranged with respect to the longitudinal axis 18, so that their respective plane surfaces 17, 19 and 17', 19' form together four supporting surfaces for a cylindrical part 20 which is arranged substantially at the middle of these four plane surfaces, the longitudinal axle of which is parallel to these plane surfaces (that is, the longitudinal axis of part 20 is perpendicular to the plane of the sheet of FIG. 1).

When the control button 12 is longitudinally moved upwardly or downwardly, both rods 15, 15' similarly move upwardly or downwardly, together with the cylindrical part 20. A control bar 21 is arranged longitudinally inside the cavity 2 of the housing 1. The bar 21 is plate-shaped and is made of a metal sheet. The bar 21 comprises a rectangular window 22, close to the upper part of bar 21. Window 22 is designed so as to accommodate the cylindric part 20. Consequently, its longitudinal size is slightly higher than the diameter of the cylindrical part 20 and its size in the direction of the longitudinal axis of the cylindric part 20 is slightly higher than the length of this cylindric part. Thus, the longitudinal displacements, that is, the displacements in the direction of the longitudinal axis 18 of the cylindrical part 20 are almost entirely transmitted to the control bar 21 since the cylindrical part 20 is placed in the rectangular window 22 of bar 21 with a minimum clearance 23.

The control bar 21 comprises near its lower part positioned inside the cavity of housing 1 a longitudinal elongated rectangular-shaped slot 24. This slot 24 substantially extends along the longitudinal axis 18 and has a width slightly larger than the thickness of a plane piece 25 made of a metal sheet, hereinafter called the hinged part. The hinged part 25 passes throughout bar 21 by crossing slot 24, so that the longitudinal displacements of the bar 21 are almost entirely transmitted to the hinged part 25.

As can be seen in FIGS. 1 and 5, the shape of the hinged part 25 is complex. This part has in its upper portion a notch 26, the bottom 27 of which forms a concave arc of a circle upwardly oriented and the lateral edges 28 and 29 of which are plane surfaces arranged according to planes joining at the curvature axis 30 of bottom 27. The notch 26 is pressed, at its bottom 27, against the upper surface of the longitudinal slot 24 provided in the control bar 21 (shown in FIG. 6), so that the hinged part 25 freely slides inside slot 24 of bar 21 according to a pivoting movement about the axis 30. The minimum interval separating the two lateral edges 28 and 29 of notch 26 is slightly higher than the thickness of rod 27, so as to be pressed against the parallel surfaces of bar 21 when the hinged part 25 is in the end pivoting position in either direction with respect to the bar 21.

The hinged part 25 comprises, in its right upper part (shown in FIGS. 1 and 5), a beak 31 having a supporting surface downwardly oriented, with beak 31 pressing against an abutment part 32 rigidly fixed on a lateral surface of a bimetal 33. The hinged part 25 further comprises in its right portion a downwardly oriented protruding part 34 having a supporting surface 35 oriented to the left, that is, oriented towards the control bar 21. The hinged part 25 further comprises a downwardly oriented protruding part 36, prolonged by a protruding part 37 oriented to the left, and having an external convex and cylindrical surface 38, the curvature axis of which corresponds to the pivoting axle 30. The downwardly oriented cylindrical surface 38 faces the lower surface of the slot 24 provided in the bar 21. Thus, the hinged part 25 can pivot about axle 30 while remaining longitudinally coupled to the bar 21, because the two cylindrical surfaces 27 and 38 face the upper and lower end surfaces, respectively, of the slot 24. So, the articulation of the hinged part 25 is formed with respect to the bar 21, without resorting to additional parts such as an articulation axle. The hinged part 25 further comprises at its left end a protruding part 39 oriented downwardly and to the right and facing the protruding part 37, to accommodate a compression spring 40 in such a way that it is engaged at its two extremities on the protruding part 39 and protruding part 37, respectively. The left extremity of spring 40 abuts against the lateral edges of the protruding part 39, that is, in abutment against the left part of the hinged part 25. The right extremity of spring 40 abuts against the left lateral wall 41 of the control bar 21. Therefore, spring 40 applies a force between the bar 21 and the hinged part 25 which tends to clockwise pivot the hinged part 25.

Figure 2:
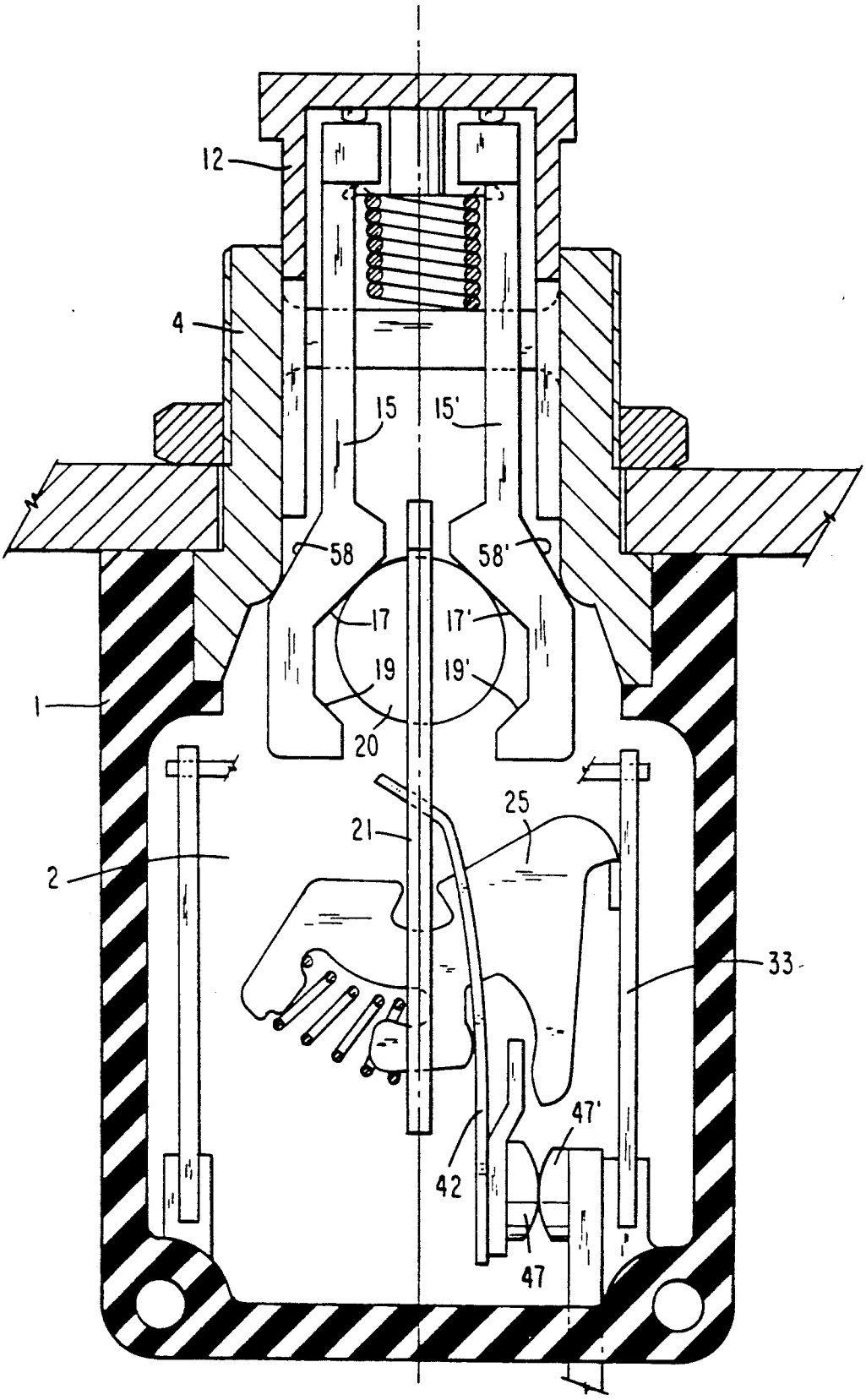
FIG. 2 is a section view similar to that of FIG. 1 wherein the breaker according to the invention is in the engaged position, under controlled movement the user.

As shown in FIGS. 1 and 7, a contact support 42 is formed as an elongated metal sheet substantially longitudinally arranged in the cavity 2. The upper end of the contact support 42 is connected to the control bar 21 by engagement in a small window 42' arranged between the lower end of window 22 and the upper end of slot 24. The connection between the upper extremity of the contact support 42 and the control bar 21 allows the contact support 42 to pivot with respect to the bar, at their junction. The contact support 42 is provided with a longitudinal slot 43 having a slightly larger width than the thickness of the hinged part 25, so as to received the hinged part 25 through the contact support 42. The bottom of slot 43 provided in the contact support 42 is limited so as not to extend to a central area 45 of the contact support 42, the left surface of this area 45 abutting against a supporting surface 49 oriented towards the right portion of the lower extremity of the protruding part 36 of the hinged part 25 (FIG. 5). The supporting surface 35, oriented to the left, provided at the extremity of the protruding part 34 of the hinged part 25 abuts against a rigid intermediate part 46 rigidly fixed at the lower extremity of the contact support 42, the part 46 supporting a mobile electric contact 47 oriented to the right and facing a fixed electric contact 47' oriented towards the left, these two electric contacts effectively facing each other when the breaker is engaged (FIG. 2).

The control bar 21 is longitudinally guided in the housing 1 by means of grooves 50, formed as sliding rails and provided in the the housing, as shown in FIG. 6.

The operation of the breaker according to the invention will be better understood while successively referring to FIGS. 1-4, which show the same device in different positions and operation modes.

In FIG. 1, the breaker is in its tripped position, that is, in the stable OFF position of the electric contacts 47 and 47'. A compression spring 50 is disposed between an upper supporting surface 51 of a supporting and guiding portion 52 of sleeve 4 and a downwardly oriented surface 53 of a supporting portion 54 connected to the upper portion 13 of the control button 12. This compression spring 50 provides a force constantly pushing upwardly on the control button 12, which upwardly draws the whole mobile mechanism mainly formed by the connecting rods 15, 15', control bar 21, hinged part 25 and contact support 42. In this position, the rods 15 and 15' are positioned inside the bore 10 of sleeve 4, relatively close to each other, their oblique supporting surfaces 17, 17' and 19, 19' surrounding the cylindrical part 20 with a minimum clearance.

When the user presses button 12 downwardly, for activating the breaker to set it to the engaged (ON) position, the longitudinally mobile parts move downwardly. Particularly, the oblique supporting surfaces 17, 17' of rods 15, 15' abut against the cylindrical part 20 to push it downwardly, and the cylindrical part 20 downwardly urges the control bar 21 as well as the mobile parts supported by the rod. As it is pulled downwardly, the beak 31 of the hinged part 25 abuts against the abutment part 32 of a bimetal element 33. While the displacement continues downwardly, the hinged part 25 counterclockwise pivots about its pivoting axle 30. The supporting surface 49 of the protruding part 36 of the hinged part pushes to the right the contact support 42, which causes it to pivot counterclockwise and brings the mobile contact 47 into contact against its fixed counterpart 47', so as to establish electric connection. Then, the position is again the same as that shown in FIG. 2.

In this position, the contact support 42 is bent, because it is made of an elastic material, and this limits the contact force of a contact 47 against the other contact 47' to a determined force corresponding to the deformation of the elastic support 42 in the engaged position of the breaker.

Figure 3:
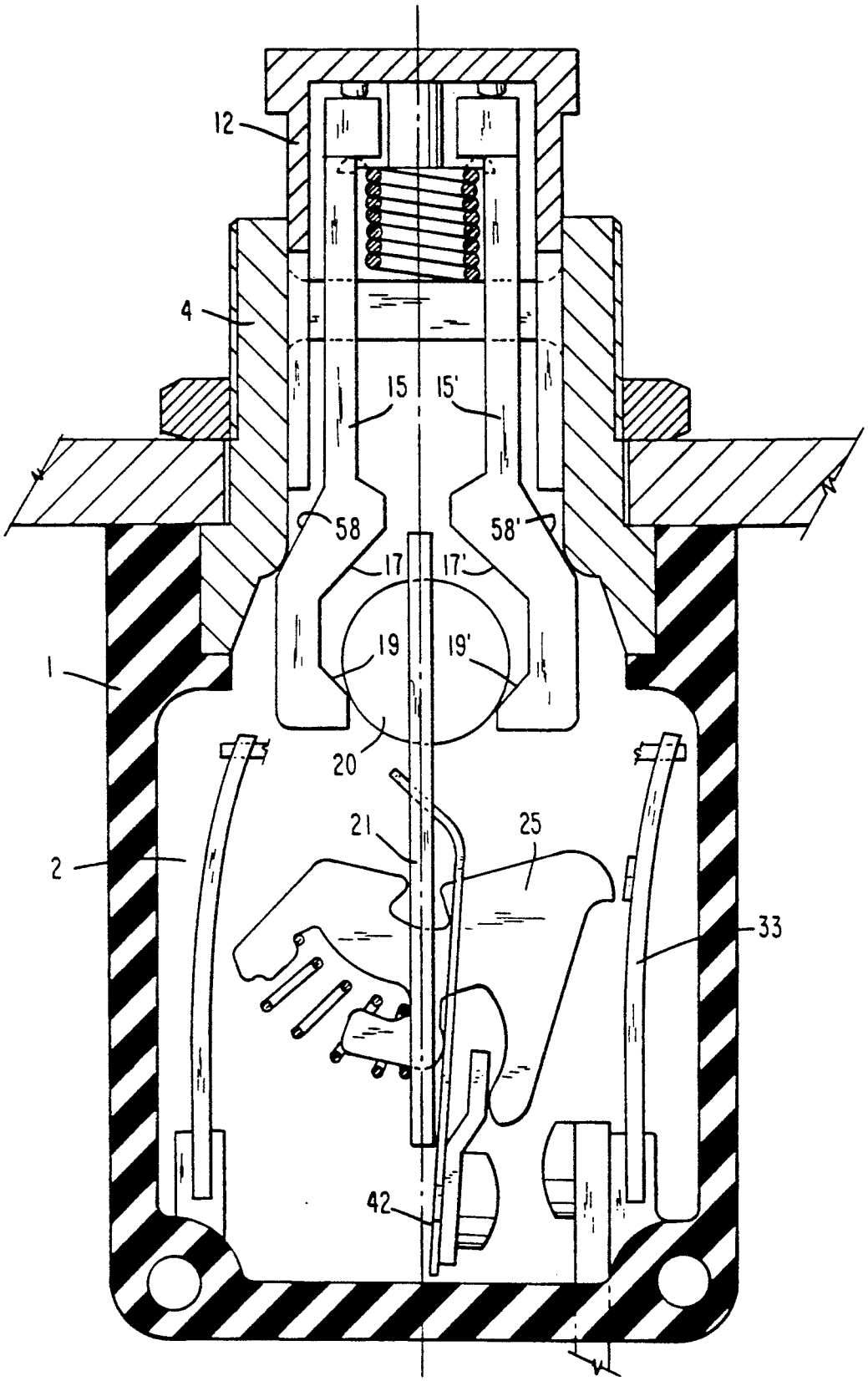
FIG. 3 is a similar sectional view of the same breaker in the tripped state, while the user is pressing the control button to engage the breaker.

If, as shown in FIG. 3, a too high electric current causes the bimetal element 33 to be shifted to the right, the abutment part 32 is released out of beak 31 and, under the influence of the compression spring 40, the hinged part 25 immediately pivots in the clockwise direction and the supporting surface 35 of its protruding part 34 pushes to the left the rigid part 46. This causes the contact support 42 to pivot in the clockwise direction, generating quick spacing apart spacing of the electric contacts 47 and 47' and hence tripping of the system. It is possible to conventionally use a set of two bimetal element 33 and 56 coupled by a joining part 53 (partially shown so as to simplify the drawing). The bimetal element 33, being, for may be a compensating bimetal element, bimetal element 56 then being the tripping bimetal. This conventional arrangement with a thermal compensating bimetal element does not materially change the above description. The device thus tripped, as shown in FIG. 3, does not remain in this position but immediately moves upwardly in the position corresponding to FIG. 1, under the influence of the compression spring 50. When the bimetal elements have cooled down, the device is ready to operate again.

Figure 4:
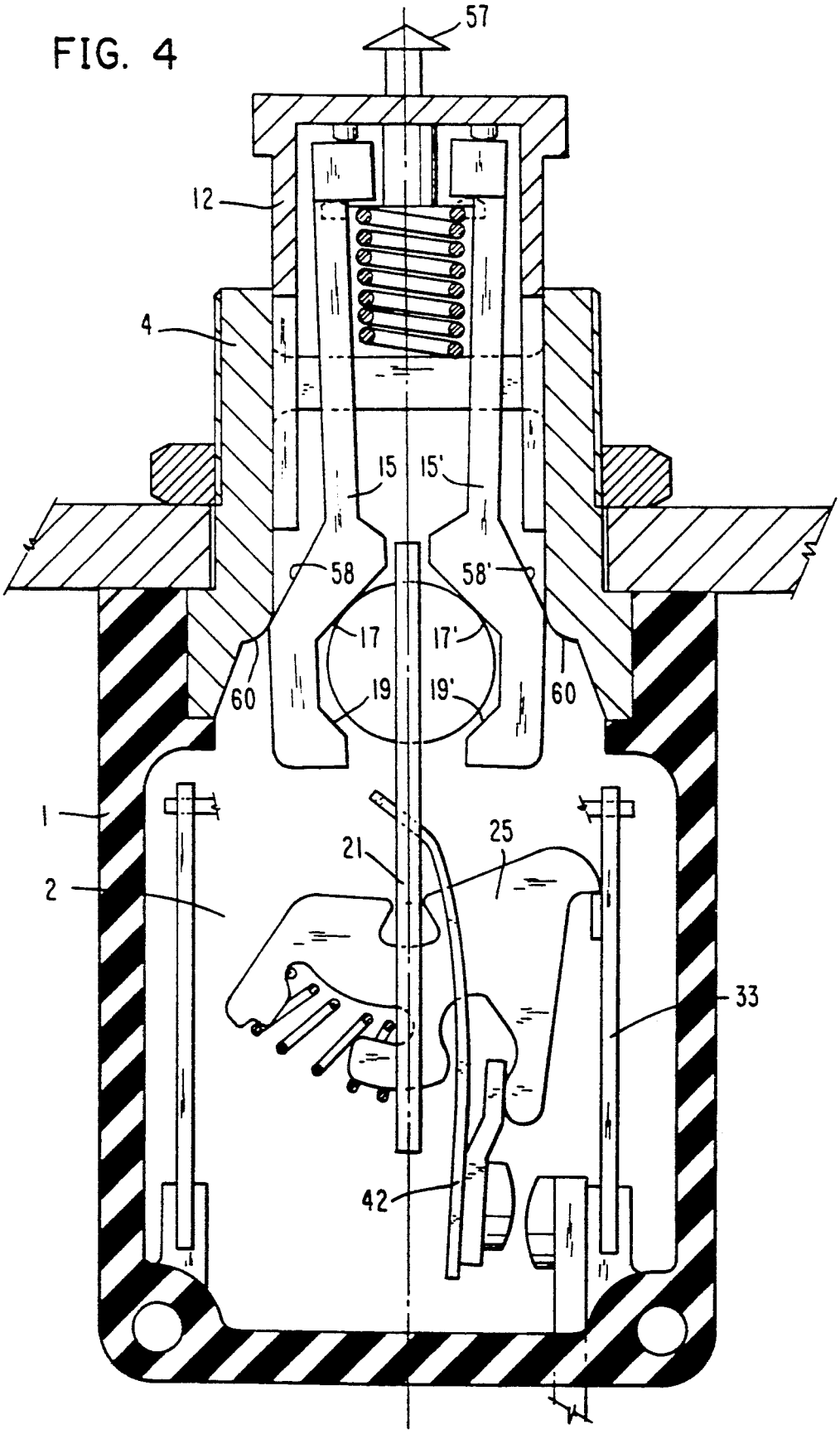
FIG. 4 is a similar section view of the same breaker wherein, while the breaker is engaged, the user is activating it to have it tripped.

When the breaker is in the engaged position, as shown in FIG. 2, a user can engage it by pulling the control button 3 upwardly, as shown by arrow 57 in FIG. 4. In FIG. 4, the control button 12 is in an intermediate position, that is, in a position it occupies during its upward displacement urged by the user. It has been noted above that, when the breaker is engaged, the compression spring 40 applies an upward reaction force onto the control bar 21, which causes forces pushing apart connecting rods 15, 15' resulting from the upward oriented contacts of the cylindrical part 20 against the oblique supporting surfaces 17, 17'. These forces block the breaker in the engaged position. However, when the user pulls button 12 upwardly, this urges the connecting rods 15, 15' upwardly. However, the rods 15, 15' are provided with oblique supporting surfaces 58 and 58' oriented in the upward direction and to the outside, which slide against a rounded lower edge 60 of bore 10 of sleeve 4. Preferably, the angle formed by the supporting surfaces 58 or 58' with the longitudinal axle 18 is lower than the angle formed by the supporting surface 17 or 17' with this longitudinal axle. Hence, a relatively weak effort oriented upwardly (arrow 57) brings back rods 15 and 15' inside bore 10 due to the fact their supporting surfaces 58 and 58' slide along the lower edge 60. At the very moment when connecting rods 15 and 15' pass inside bore 10, there is no longer any friction effort between the supporting surfaces 58 and 58' and the lower edge 60, which decreases the upward displacement resistance of the control button 12, thus causing a rapid release action. The OFF state of the electric contact is very rapidly reached, which permits avoiding formation of an electric arc between contacts 47 and 47'.

When button 12 is being moved from its highest position to its intermediate position, the connecting rods 15, 15' slide inside bore 10 and consequently the upward or downward displacement of button 12 causes a displacement of equal amplitude of bar 21. When button 12 is moved close to its intermediate position (corresponding to the position shown in FIG. 4), rods 15, 15' slide at their surfaces 58, 58' on lower edge 60 of sleeve 4, while getting closer or farther, whereby the displacement of button 12 causes a lower amplitude displacement of bar 21. This demultiplication of movement causes an effort threshold effect during manual activation of button 12 in the engagement or release position.

The structure of the breaker according to the invention is very simple, particularly because the number of components is very small and because there is no complicated articulation device using pivoting articulation axles. In addition, the operation of the breaker according to the invention is reliable, particularly due to the fact that, during manual engagement, release operations or tripping, the electric contacts 47 and 47' are very rapidly drawn together or separated, which highly limits the formation of a damaging electric arc.

In this disclosure, thee are shown and described only the preferred embodiments of the invention, but, as aforementioned, it is to be understood that the invention is capable of use in various other combinations and environments and is capable of changes or modifications within the scope of the inventive concept as expressed herein.

I claim:

1. A breaker comprising:

a housing defining a cavity;

a control button disposed so as to linearly move along an upper part of said housing;

a control bar longitudinally arranged inside said housing and disposed to be moved under the influence of a force provided by said control button;

a hinged part mounted so as to pivot around said control bar and to determine selectively either the engagement or release state of said breaker; and two rods mounted so as to pivot inside an upper part of said control button and to extend downwardly at the outside of said control button towards the cavity of said housing, said rods each comprising an oblique supporting surface oriented in the inward and downward position and a second lower oblique supporting surface oriented in the inward and upward position, with said oblique supporting surfaces surrounding and maintaining a cylindrical part coupled to the upper portion of said bar, said rods further comprising an oblique supporting surface outwardly and upwardly directed to slide against a lower edge of a bore of the upper portion of said housing whereby, when said control button is moved upwardly, said rods slide at their respective supporting surfaces against a lower flange of the bore to cause said rods to move closer to each other to allow them to pass through said bore when said control button is in its higher tripping position.

2. A breaker according to claim 1, wherein:

an angle formed by the first oblique supporting surface oriented in the inward and downward position with respect to a longitudinal axis of the housing is higher than an angle formed by the oblique supporting surface oriented in the outside and upward position, so that, when said control button is moved along a higher first part of its displacement said rods slide inside said bore of the upper portion of the housing and cause a displacement of said control bar of the same amplitude as the displacement of the control button, and when said control button is moved along a lower second part of its displacement said rods slide out of said bore and their supporting surfaces slide along the lower flange, so that the displacement of said control button causes a smaller displacement of said control bar.

* * * * *